US010461427B2

(12) United States Patent
Hwang et al.

(10) Patent No.: US 10,461,427 B2
(45) Date of Patent: Oct. 29, 2019

(54) ANTENNA AND ELECTRONIC DEVICES COMPRISING THE SAME

(71) Applicant: Samsung Electronics Co., Ltd., Suwon-si, Gyeonggi-do (KR)

(72) Inventors: Soon Ho Hwang, Seoul (KR); Sung Koo Park, Suwon-si (KR); Joon Ho Byun, Yongin-si (KR); Chan Kyu An, Incheon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 125 days.

(21) Appl. No.: 14/681,521

(22) Filed: Apr. 8, 2015

(65) Prior Publication Data

US 2016/0301138 A1 Oct. 13, 2016

(51) Int. Cl.
*H01Q 9/04* (2006.01)
*H01Q 1/24* (2006.01)
*H01Q 9/42* (2006.01)

(52) U.S. Cl.
CPC ..... *H01Q 9/0407* (2013.01); *H01Q 1/243* (2013.01); *H01Q 9/42* (2013.01)

(58) Field of Classification Search
CPC ..... H01Q 9/0407; H01Q 9/42; H01Q 1/243
See application file for complete search history.

(56) References Cited

U.S. PATENT DOCUMENTS 8,872,706 B2 10/2014 Caballero et al.
8,878,732 B1 11/2014 Sung et al.
8,988,290 B2 3/2015 Ozden et al.
9,343,804 B2 5/2016 Oh et al.
2002/0190905 A1 12/2002 Flint et al.
2004/0154766 A1 8/2004 Rancien et al.
2006/0208951 A1 9/2006 Korva et al.
2008/0202715 A1 8/2008 Rancien et al.
2009/0315789 A1 12/2009 Sung et al.
2010/0123633 A1 5/2010 Ozden et al.
2012/0112969 A1 5/2012 Caballero et al.
2012/0212378 A1 8/2012 Sung et al.
2012/0262345 A1 10/2012 Kim et al.
2013/0027254 A1 1/2013 Korva et al.
2013/0027270 A1 1/2013 Von Arbin et al.
2013/0057437 A1 3/2013 Chiu et al.
2013/0099980 A1* 4/2013 Hayashi ..... H01Q 9/42 343/700 MS (Continued)

FOREIGN PATENT DOCUMENTS

EP 2 500 979 A2 9/2012
EP 2511979 A1 10/2012

(Continued)

OTHER PUBLICATIONS

European Office Action dated Feb. 7, 2019, Application #: 15 162 919.3-1206; Ref. # P6055735EP.

*Primary Examiner* — Jessica Han
*Assistant Examiner* — Michael Bouizza
(74) *Attorney, Agent, or Firm* — Jefferson IP Law, LLP

(57) ABSTRACT

An electronic device having an antenna is provided. The electronic device includes a substrate including a grounding area, a non-grounding area and at least one feeding unit for feeding an antenna radiator, and a non-segmented metal cover forming an outer frame of the electronic device and operating as a part of the antenna.

8 Claims, 12 Drawing Sheets

(56) References Cited

U.S. PATENT DOCUMENTS

| | | | | |
|---|---|---|---|---|
| 2013/0135158 | A1 | 5/2013 | Faraone et al. | |
| 2013/0234910 | A1 | 9/2013 | Oh et al. | |
| 2013/0241780 | A1* | 9/2013 | Amm | H01Q 1/243 343/702 |
| 2013/0321221 | A1 | 12/2013 | Sung et al. | |
| 2014/0062801 | A1 | 3/2014 | Yong et al. | |
| 2014/0087674 | A1 | 3/2014 | Teng et al. | |
| 2014/0206417 | A1 | 7/2014 | Sung et al. | |
| 2014/0320379 | A1* | 10/2014 | Hamabe | H01Q 9/42 343/893 |
| 2014/0354491 | A1 | 12/2014 | Kim et al. | |
| 2015/0005037 | A1 | 1/2015 | Caballero et al. | |
| 2015/0255857 | A1 | 9/2015 | Kim et al. | |
| 2015/0270602 | A1 | 9/2015 | Sung et al. | |

FOREIGN PATENT DOCUMENTS

| | | | |
|---|---|---|---|
| EP | 2562870 | A1 | 2/2013 |
| EP | 2 639 879 | A2 | 9/2013 |
| EP | 2 690 704 | A1 | 1/2014 |
| FR | 2827986 | A1 | 1/2003 |
| JP | 2013106320 | A | 5/2013 |
| WO | 2013107921 | A1 | 7/2013 |

* cited by examiner

ANTENNA AND ELECTRONIC DEVICES COMPRISING THE SAME

CROSS-REFERENCE TO RELATED APPLICATION(S)

This application claims the benefit under 35 U.S.C. § 119(a) of a Korean patent application filed on Apr. 9, 2014 in the Korean Intellectual Property Office and assigned Serial number 10-2014-0042593, the entire disclosure of which is hereby incorporated by reference.

TECHNICAL FIELD

The present disclosure relates to a method for forming an outer frame of an electronic device using a metal material to use the metal material as a part of an antenna.

BACKGROUND

A wireless communication technology has been recently developed as an important means for easily transferring and sharing various types of data, such as sounds, images and pictures. With the development of the wireless communication technology, information has been diversified and a communication speed has been improved.

With the trend of digital convergence, electronic devices, such as smartphones and tablets provide various functions. For example, services based on functions of communication technologies, such as digital multimedia broadcasting, (DMB), global positioning system (GPS), Bluetooth (BT), radio frequency identification (RFID) and wireless-fidelity (Wi-Fi) may be provided. To provide such services, an electronic device may be provided with one or more antennas. The electronic device may radiate radio waves (signals) to free space (e.g., air) or may receive radio waves from the free space using the antennas, thereby performing wireless communication.

Currently, it is a trend to decrease the thicknesses of electronic devices, such as smartphones or tablets and increase the sizes of screens of the electronic devices. A thin and large screen may satisfy a user, but may be vulnerable to external impact. In order to improve impact resistance, tempered front glass or reinforced plastic may be used for an external structure of an electronic device. In the case where a metallic case is used to improve durability, the performance of an antenna installed in the electronic device may be degraded. Furthermore, even though a part of the metallic case is used as an antenna, the antenna performance may be degraded.

FIG. 1 is a diagram illustrating an electronic device in which a metallic case is used as an antenna according to the related art.

Referring to FIG. 1, a rear surface of an electronic device 100 may include an upper metal area 101, an intermediate metal area 103, and a lower metal area 105. Furthermore, the electronic device 100 may include a segmentation structure 111 for dividing the upper metal area 101 from the intermediate metal area 103, and a segmentation structure 113 for dividing the intermediate metal area 103 from the lower metal area 105. In addition, a rear camera 120 may be exposed on the rear surface.

According to the electronic device illustrated in FIG. 1, the upper metal area 101 may operate as a radiator of an antenna. The segmentation structure 111 may be designed so that the upper metal area 101 has an appropriate length or area for receiving a signal of a target frequency band.

However, if a part (e.g., a finger or a cheek) of a body of a user contacts the segmentation structure 111 (or the segmentation structure 113), the performance of the antenna may be degraded. For example, due to the body contacting the segmentation structure 111, the upper metal area 101 may be electrically connected to the intermediate metal area 103, thereby changing the characteristic of the antenna. The changed antenna characteristic may not be suitable for transmitting/receiving the signal of the target frequency band.

Therefore, a need exists for an electronic device to which a metal case is applied, wherein the electronic device may have the same performance as that obtained when the metal case is not used or improved performance, and may minimize the degradation of the performance when a human body contacts the case.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide an electronic device to which a metal case is applied, wherein the electronic device may have the same performance as that obtained when the metal case is not used or improved performance, and may minimize the degradation of the performance when a human body contacts the case.

In accordance with an aspect of the present disclosure, an electronic device having an antenna is provided. The electronic device includes a substrate including a grounding area, a non-grounding area and at least one feeding unit for feeding an antenna radiator, and a non-segmented metal cover forming an outer frame of the electronic device and operating as a part of the antenna.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

Figure 1:
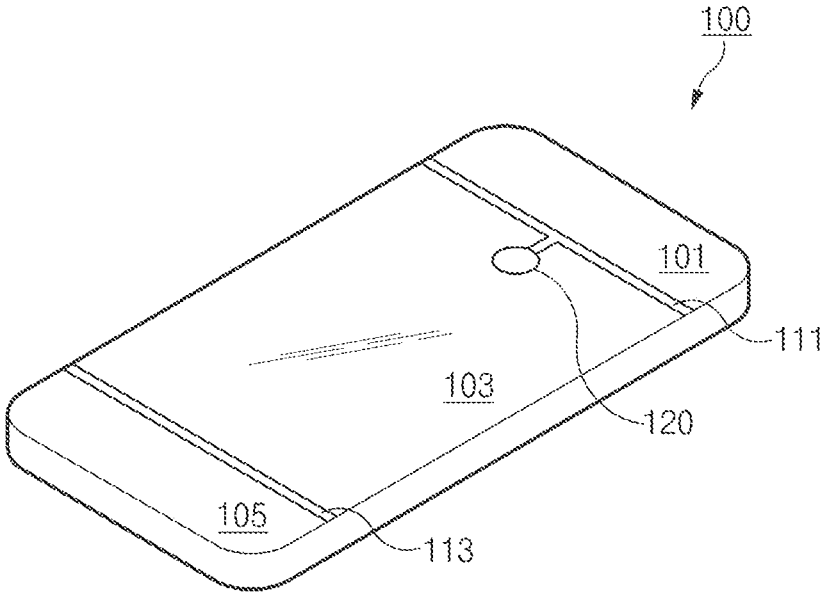
FIG. 1 (RELATED ART)
FIG. 1 is a diagram illustrating an electronic device in which a metallic case is used as an antenna according to the related art.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

By the term "substantially" it is meant that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

The term "include," "comprise," "including," or "comprising" used herein indicates disclosed functions, operations, or existence of elements but does not exclude other functions, operations or elements. It should be further understood that the term "include", "comprise", "have", "including", "comprising", or "having" used herein specifies the presence of stated features, integers, operations, elements, components, or combinations thereof but does not preclude the presence or addition of one or more other features, integers, operations, elements, components, or combinations thereof.

The meaning of the term "or" or "at least one of A and/or B" used herein includes any combination of words listed together with the term. For example, the expression "A or B" or "at least one of A and/or B" may indicate A, B, or both A and B.

The terms, such as "first", "second", and the like used herein may refer to various elements of various embodiments of the present disclosure, but do not limit the elements. For example, such terms do not limit the order and/or priority of the elements. Furthermore, such terms may be used to distinguish one element from another element. For example, "a first user device" and "a second user device" indicate different user devices. For example, without departing the scope of the present disclosure, a first element may be referred to as a second element, and similarly, a second element may be referred to as a first element.

It will be understood that when an element is referred to as being "connected" or "coupled" to another element, it can be directly connected or coupled to the other element or intervening elements may be present. In contrast, when an element is referred to as being "directly connected" or "directly coupled" to another element, it should be understood that there are no intervening elements. For example, in the case where an antenna radiator is connected to a circuit substrate for the purpose of feeding, the feeding may include both feeding through a direct connection and feeding through an indirect connection (e.g., coupling feeding). Furthermore, ground contact includes both a direct connection and indirect connection between a grounding area and an antenna. For example, in the present disclosure, the term "connection" or an electrical configuration that may be construed as "connection" includes a direct connection or an indirection connection, and may be established electrically and does not need to be established physically, unless otherwise specified or the above-mentioned configuration is illogical or cannot be carried out by those skilled in the art.

The terminology used herein is not for delimiting the various embodiments of the present disclosure but for describing specific examples of the present disclosure.

The terms used herein, including technical or scientific terms, have the same meanings as understood by those skilled in the art. It should be further understood that terms in common usage should also be interpreted as is customary in the relevant art and not in an idealized or overly formal detect unless expressly so defined herein.

Electronic devices according to various embodiments of the present disclosure may include a metal case. For example, the electronic devices may include at least one of smartphones, tablet personal computers (PCs), mobile phones, video telephones, electronic book readers, desktop PCs, laptop PCs, netbook computers, personal digital assistants (PDAs), portable multimedia players (PMPs), Motion Picture Experts Group (MPEG-1 or MPEG-2) Audio Layer 3 (MP3) players, mobile medical devices, cameras, wearable devices (e.g., head-mounted-devices (HMDs), such as electronic glasses), an electronic apparel, electronic bracelets, electronic necklaces, electronic appcessories, electronic tattoos, smart watches, and the like.

According to various embodiments of the present disclosure, the electronic devices may be smart home appliances including metal cases. The smart home appliances may include at least one of, for example, televisions (TVs), digital versatile disc (DVD) players, audios, refrigerators, air conditioners, cleaners, ovens, microwave ovens, washing machines, air cleaners, set-top boxes, TV boxes (e.g., Samsung HomeSync™, Apple TV™, or Google TV™), game consoles, electronic dictionaries, electronic keys, camcorders, electronic picture frames, and the like.

According to various embodiments of the present disclosure, the electronic devices may include at least one of medical devices (e.g., a magnetic resonance angiography (MRA), a magnetic resonance imaging (MRI), a computed tomography (CT), scanners, and ultrasonic devices), navigation devices, global positioning system (GPS) receivers, event data recorders (EDRs), flight data recorders (FDRs), vehicle infotainment devices, electronic equipment for vessels (e.g., navigation systems and gyrocompasses), avionics, security devices, head units for vehicles, industrial or home robots, automatic teller's machines (ATMs), and points of sales (POSs) including metal cases.

According to various embodiments of the present disclosure, the electronic devices may include at least one of parts of furniture or buildings/structures having communication functions, electronic boards, electronic signature receiving devices, projectors, and measuring instruments (e.g., water meters, electricity meters, gas meters, and wave meters) including metal cases. The electronic devices according to various embodiments of the present disclosure may be one or more combinations of the above-mentioned devices. Furthermore, the electronic devices according to various embodiments of the present disclosure may be flexible devices. It would be obvious to those skilled in the art that the electronic devices according to various embodiments of the present disclosure are not limited to the above-mentioned devices.

In various embodiments of the present disclosure, the term "case" may represent a part of the entirety of an outer frame of an electronic device. For example, a metal case may be construed as a metal ring, a metal front cover, a metal battery cover, a metal rear cover, and the like. Specifically, the case may represent a battery case that covers the rear of the electronic device. In various embodiments of the present disclosure, the case may represent a ring-type case that surrounds a side of the electronic device. For example, in the case of a smartphone, the case may represent a metal ring surrounding a side of the smartphone and having four rounded corners. In various embodiments of the present disclosure, the term "metal case" may represent a part or the entirety of a metallic area excepting a display, a receiver and a speaker which are exposed to the outside. For example, the outer frame of the electronic device may be formed of a combination of a display, a metal case and an injection-molded case.

Hereinafter, electronic devices according to various embodiments of the present disclosure will be described with reference to the accompanying drawings. The term "user" used herein may refer to a person who uses an electronic device or may refer to a device (e.g., an artificial electronic device) that uses an electronic device.

Figure 2:
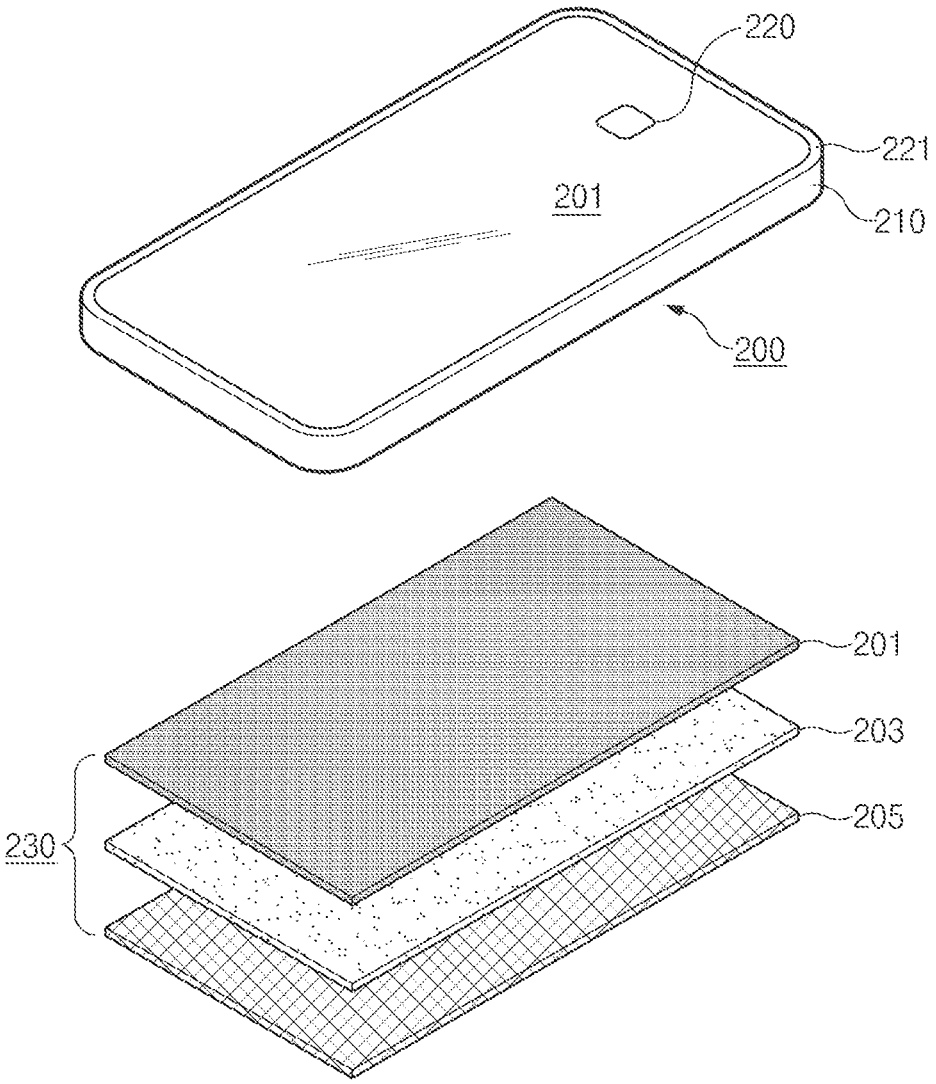
FIG. 2 is a conceptual diagram illustrating an electronic device according to various embodiments of the present disclosure.

FIG. 2 is a conceptual diagram illustrating an electronic device according to various embodiments of the present disclosure.

Referring to FIG. 2, an outer frame of an electronic device 200 may include a rear case 201, a side case 210, and a case connection part 221 arranged therebetween. In various embodiments of the present disclosure, the outer frame of the electronic device 200 may include a rear camera 220 or an external port (not illustrated). In various embodiments of the present disclosure, the case connection part 221 and the side case 210 may be formed as one piece. For example, the outer frame of the electronic device 200 may be formed by coupling the rear case 201 with the side case 210. Although not illustrated, the side case 210 may be arranged so as to be physically adjacent to a display panel (or tempered glass) disposed on a front surface of the electronic device.

In various embodiments of the present disclosure, the metal case may be a metallic ring (e.g., the side case 210) forming the outer frame of the electronic device. In various embodiments of the present disclosure, the metal case may be a rear case (e.g., the rear case 201), such as a rear battery case. In the case where the rear case 201 is formed of metal, a side (e.g., the side case 210) of the electronic device may be formed of a nonmetal material.

Referring to FIG. 2, in various embodiments of the present disclosure, the electronic device 200 may include the rear case 201, a substrate 203, and a display panel 205. The rear case 201, the substrate 203, and the display panel 205 may form layers arranged vertically at different positions. The forms of the elements illustrated in FIG. 2 are merely simplified examples for ease of description, and thus, the rear case 201, the substrate 203, and the display panel 205 may have various sizes and shapes. For example, the substrate 203 may include a main printed circuit board (PCB) and a sub PCB, or three or more PCBs.

The electronic device 200 may include a nonmetal area 230. The nonmetal area 230 may be arranged between the rear case 201 and the substrate 203 or between the substrate 203 and the display panel 205. In various embodiments of the present disclosure, the nonmetal area 230 may be arranged between the side case 210 and the substrate 203. The nonmetal area 230 may be provided as an empty space, or may be filled with a dielectric having a dielectric constant. In various embodiments of the present disclosure, the nonmetal area 230 may be formed by separating the side case 210 from the substrate 203 by a certain distance.

In various embodiments of the present disclosure, an antenna radiator may be arranged in the nonmetal area 230 of the electronic device 200. Even though the antenna radiator is arranged in the nonmetal area 230, a metal material of the electronic device 220, such as the metal case or an internal metal component, may affect a radiation performance of an antenna.

In various embodiments of the present disclosure, the antenna may be implemented using the substrate 203 and a substrate 205 (e.g., ground) without being connected to the metal case, or may be connected to the metal case so as to be implemented, in the nonmetal area 230. In various embodiments of the present disclosure, the antenna may have a structure of a dipole antenna, a folded dipole antenna, a monopole antenna, a planar inverted F-antenna (PIFA), a loop antenna, and the like. In various embodiments of the present disclosure, the antenna may have a pattern of a meander type, curved type or linear type or another geometric pattern. In various embodiments of the present disclosure, the antenna included in the electronic device 200 may have at least one feeding structure. The antenna may be implemented without being connected to the antenna to the metal case, or may be implemented by forming at least one connection between the antenna and the metal case. Furthermore, in the case where the antenna (antenna radiator) is arranged in the nonmetal area 230, the antenna may be connected to a metal component of the electronic device 200, such as a PCB so as to be implemented. In various embodiments of the present disclosure, the metal component may be used as a part of the antenna or may be used as a matching element. For example, the metal component may include a microphone, a sensor, a universal serial bus (USB) connector, and a key flexible PCB (FPCB).

In various embodiments of the present disclosure, a part or the entirety of the metal case may be used as a grounding area of the antenna, or may be used as a part of the antenna radiator. Furthermore, the metal case may serve for antenna matching. When the metal case serves for antenna matching, some or all of metal structures of the electronic device, including the metal case, may be physically or electronically connected to each other. Alternatively, the metal structures may be physically separated from each other. In various embodiments of the present disclosure, the metal structures may be connected to each other by means of a screw, a c-clip, a conductive tape, a conductive adhesive, a pogo pin or the like. In various embodiments of the present disclosure, a metal structure may be connected as an additional conductive reinforcing structure using the above-mentioned method.

In various embodiments of the present disclosure, a non-segmented metal case which is not divided into different segments by a segmentation structure (e.g., the segmentation structures 111 and 113) may be regarded as the rear case 201. However, in some embodiments of the present disclosure, the non-segmented metal case may be regarded as a metal ring (e.g., 210 of FIG. 2). In this case, the rear case 201 may be formed of a nonmetal material.

In various embodiments of the present disclosure, the metal case (e.g., the rear case 201) may form the outer frame of the electronic device so as to improve the robustness of the electronic device while serving as a part of the antenna. For example, the metal case may be used to secure a grounding area of the antenna, may be used as the radiator of the antenna, or may be used as an element for impedance matching of the antenna. Examples of such utilization of the metal case will be described below.

In various embodiments of the present disclosure, the display panel 205 may be connected to the substrate 203 so as to provide the grounding area for the antenna.

Figure 3:
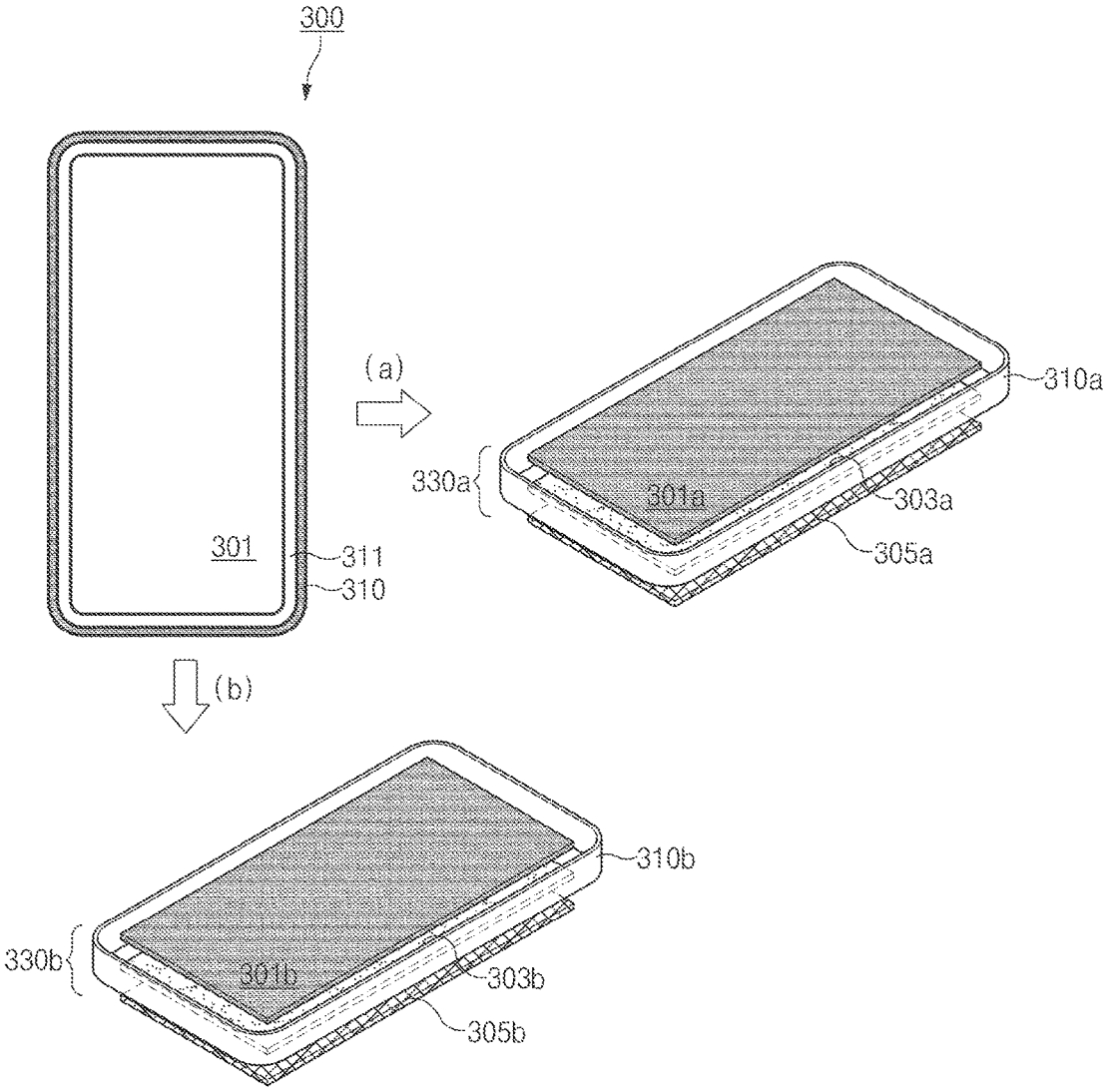
FIG. 3 is a block diagram illustrating a metal case according to various embodiments of the present disclosure.

FIG. 3 is a block diagram illustrating a metal case according to various embodiments of the present disclosure.

Referring to FIG. 3, an electronic device 300 may include a rear case 301 and a side ring 310. A nonmetal area 311 may be arranged between the rear case 301 and the side ring 310.

In the example of (a) of FIG. 3, the electronic device 300 may include a rear case 301*a*, a substrate 303*a*, and a display 305*a*. The rear case 301*a*, the substrate 303*a*, and the display 305*a* may be spaced apart at certain intervals, and a nonmetal area 330*a* may be laterally formed. Furthermore, the outer frame of the electronic device may be formed by the rear case 301*a*, a side case 310*a*, and the front display panel 305*a*.

In the example of (a) of FIG. 3, both the rear case 301*a* and the side case 310*a* may be metal structures. The metal structures may be formed of conductive materials, and may have different conductivities. In this case, the nonmetal area 311 may be provided to divide the rear case 301*a* from the side case 310*a*. Both the rear case 301*a* and the side case 310*a* may be formed so as not to have a segmentation structure. In various embodiments of the present disclosure, the metal structures may not be connected to each other, or at least two or all of the metal structures may be connected to each other. In the case where the metal structures are connected to each other, the metal structures may be connected to each other at one or more points, or may be connected to each other through a matching element, such as an inductor or a capacitor.

In the example of (b) of FIG. 3, the electronic device 300 may include a rear case 301*b*, a substrate 303*b*, and a display 305*b*. The rear case 301*b*, the substrate 303*b*, and the display 305*b* may be spaced apart at certain intervals, and a nonmetal area 330*b* may be laterally formed. Furthermore, the outer frame of the electronic device may be formed by the rear case 301*b*, a side case 310*b*, and the front display panel 305*b*. The side case 310*b* may be a metal structure, but the rear case 301*b* may not be a metal structure. For example, the rear case 301*b* may be an injection-molded battery case.

In various embodiments of the present disclosure, in the electronic device 300 or 200, the rear case (e.g., the rear case 201) may be formed as a metal structure, the side case (e.g., the side case 310*b*) may be formed as a metal structure, or both the rear case and the side case (e.g., the rear case 301*a* and the side case 310*b*) may be formed as metal structures. In any case, the rear case or the side case may not have a segmentation structure.

Figure 4:
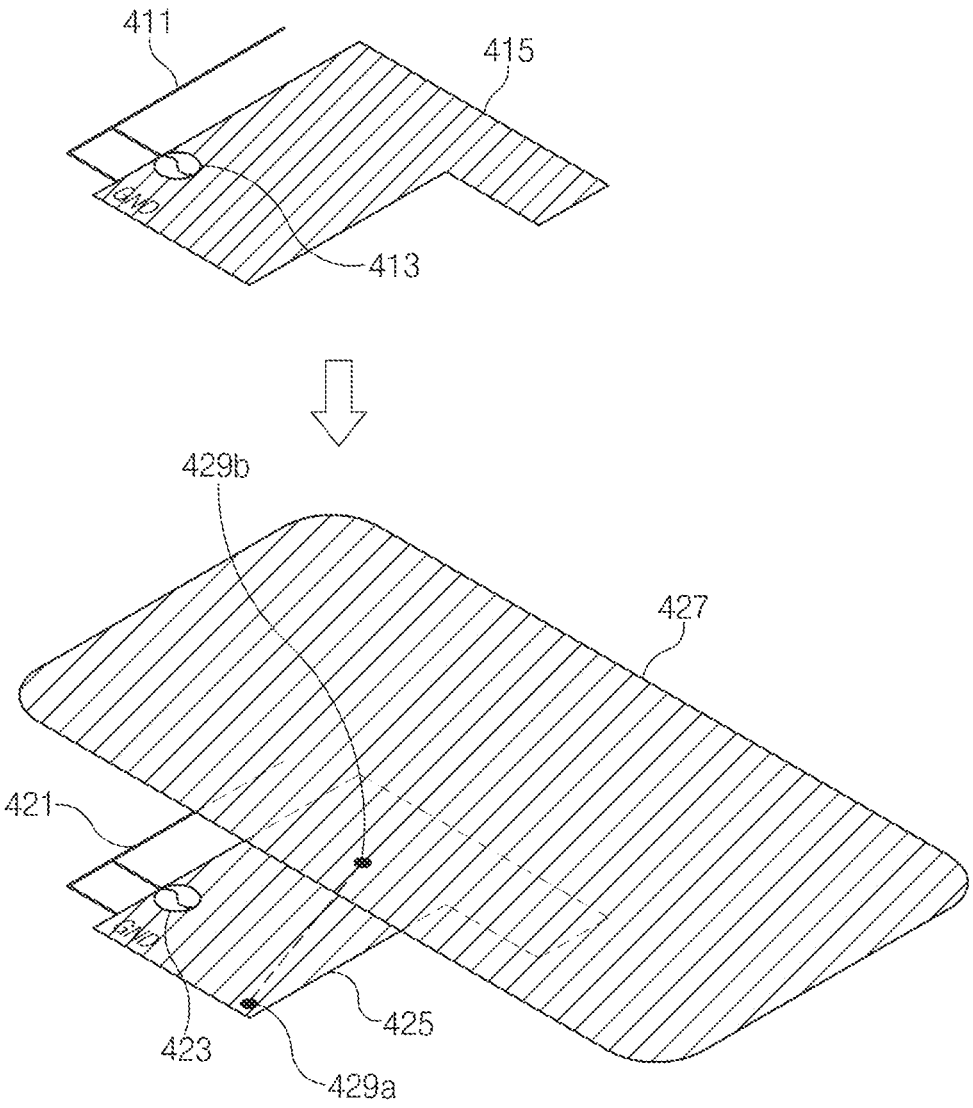
FIG. 4 is a diagram illustrating a method of using a metal case as an additional grounding area according to various embodiments of the present disclosure.

FIG. 4 is a diagram illustrating a method of using a metal case as an additional grounding area according to various embodiments of the present disclosure.

Referring to FIG. 4, an antenna of an electronic device (e.g., the electronic device 200) may include a radiator 411, a feeding unit 413 for feeding the radiator 411, and a substrate 415 for providing areas of the feeding unit 413 and a ground GND.

In many cases, in order to secure sufficient performance of an antenna, a sufficient grounding area may be provided. However, as electronic devices become smaller, and the sizes of batteries installed in electronic devices and the types and number of components therein increase, a substrate (e.g., the substrate 415) or a display ground (e.g., the display panel 205) connected to the substrate may not provide a sufficient grounding area.

In various embodiments of the present disclosure, for example, in the example illustrated in the lower part of FIG. 4, the electronic device may use a rear metal case as an additional grounding area. For example, a substrate 425 may provide a grounding area and a feeding unit 423 for feeding a radiator 421. Furthermore, one point 429*a* of the substrate 425 may be connected to one point 429*b* of a rear metal case 427. This connection may be performed using a c-clip, a pogo pin, or another metal material. In this manner, the metal case 427 is used as a grounding area, so that the electronic device secures a sufficient grounding area for the antenna radiator 421.

Figure 5:
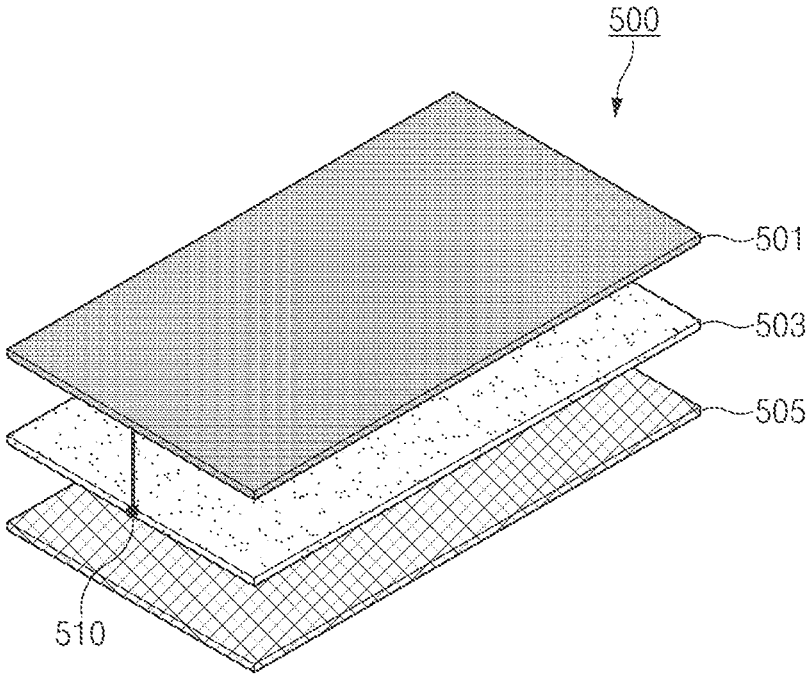
FIG. 5 is a diagram illustrating a method of using a metal case as an antenna radiator according to various embodiments of the present disclosure.

FIG. 5 is a diagram illustrating a method of using a metal case as an antenna radiator according to various embodiments of the present disclosure.

Referring to FIG. 5, an electronic device 500 may include a metal case 501, a substrate 503, and a display panel 505. In various embodiments of the present disclosure, a feeding line starting from the substrate 503 may be directly connected to the metal case 501. In various embodiments of the present disclosure, the feeding line may be connected to not only the metal case 501 but also another metal structure, so that the metal structure may be used as an antenna or a part of the antenna.

Although FIG. 5 illustrates an antenna structure of the electronic device 500 as if a feeding unit 510 located on one point of a side of the substrate 503 directly fed the metal case 501, the feeding location and method are not limited to the example illustrated in FIG. 5. For example, the feeding unit 510 may be located on an arbitrary point in the substrate 503 so as to feed an arbitrary point of the metal case 501. Furthermore, the substrate 503 may have at least one feeding unit or feeding line.

Figure 6:
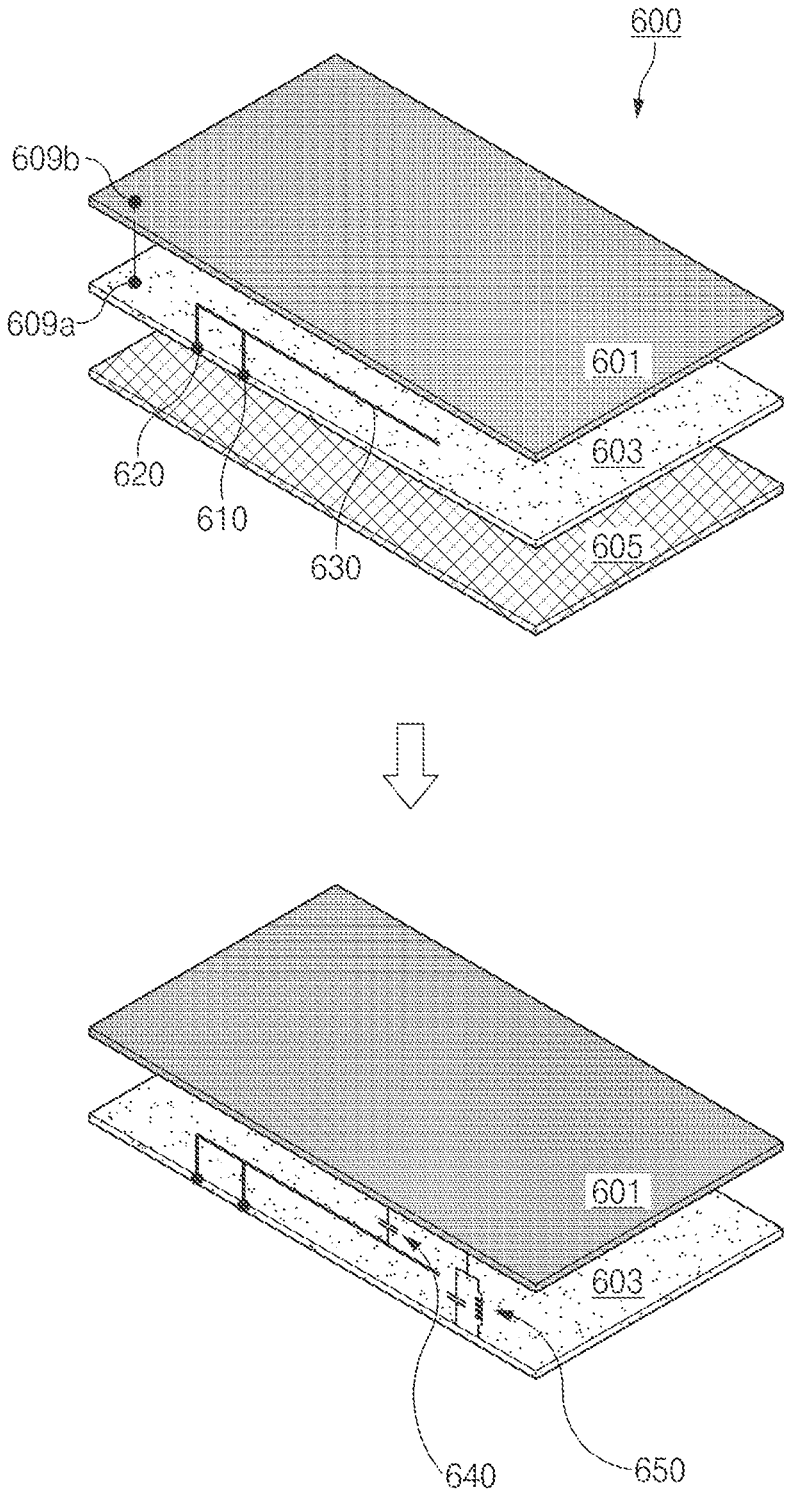
FIG. 6 is a diagram illustrating antenna impedance matching using a metal case according to various embodiments of the present disclosure.

FIG. 6 is a diagram illustrating antenna impedance matching using a metal case according to various embodiments of the present disclosure.

Referring to FIG. 6, an electronic device 600 may include a metal case 601, a substrate 603, and a display panel 605. The display panel 605 may be connected to the substrate 603 so as to operate as a ground of an antenna. The substrate 603 may include a feeding unit 610 and a grounding part 620, and a radiator 630 may be connected to the feeding unit 610 and the grounding part 620. Furthermore, one point 609*a* of the substrate 603 may be connected to one point 609*b* of the metal case 601 for the purpose of grounding.

In various embodiments of the present disclosure, the radiator 630 may be formed at a side (e.g., a nonmetal area) of the electronic device. Since both the radiator 630 and the metal case 601 are formed of a metal material, a capacitor element 640 may be generated depending on the shapes, lengths and sizes of the radiator 630 and the metal case 601. Furthermore, due to at least one connection (e.g., a connection between the point 609*a* and the point 609*b*) established between the metal case 601 and the substrate 603 for the purpose of grounding, an inductor element and/or a capacitor element 650 may be generated. In various embodiments of the present disclosure, the capacitor element may be changed according to a characteristic (e.g., dielectric constant) of a material that forms a nonmetal area and a distance between metal materials.

In general, in the case where a metal plate, such as a metal case is arranged around an antenna radiator, the performance of an antenna may be degraded. Therefore, if a rear case of an electronic device, such as a smartphone is made of a metal material, the performance of an antenna for $3^{rd}$ generation (3G), long term evolution (LTE), Wi-Fi, GPS, BT, near field communication (NFC) or infrared data association (IrDA) communication installed in the smartphone may be degraded. However, in various embodiments of the present disclosure, a metal case is used as an antenna matching unit by controlling a distance between the metal case and an antenna radiator, a length of the antenna radiator, a distance between the metal case and a substrate, the number of connections for grounding between the metal case and the substrate, and a material of a nonmetal area in which the antenna radiator is arranged, whereby the degradation of the performance of an antenna due to the metal case may be prevented or the antenna performance may be even more improved.

FIGS. 7A and 7B illustrate a method of arranging an antenna radiator in a nonmetal area between a metal case and a substrate according to various embodiments of the present disclosure.

Referring to FIGS. 7A and 7B, an electronic device 700 may include a metal case 701, a substrate 703, and a display panel 705. Furthermore, the electronic device 700 may include an antenna radiator extending from and fed by the substrate 703. The antenna radiator may be arranged in the nonmetal area of the electronic device.

In various embodiments of the present disclosure, the electronic device 700 may be provided with a plurality of antenna radiators extending from the substrate 703. For example, the electronic device 700 may include a radiator 731 fed by a feeding unit 711 and a radiator 732 fed by a feeding unit 712. Although the antenna radiator (e.g., the radiator 731) is illustrated as a monopole antenna type in the example of FIG. 7A, the antenna radiator may also have an inverted-F antenna (IFA)-type antenna structure that extends from one point of the antenna radiator so as to be grounded by a grounding area of the substrate 703 or another grounding part of the electronic device 700. Besides these antenna structures, the electronic device 700 may have the above-mentioned various antenna structures (e.g., a loop antenna).

In various embodiments of the present disclosure, the radiator 731 or 732 may induce a coupling phenomenon with the metal case 701 or may adjust a current, thereby improving the performance of the antenna. As described above with reference to FIG. 6, the metal case 701 may serve as a matching element of the antenna. The metal case 701 may be connected to the substrate 703 at one or more points for the purpose of grounding.

In the example of FIG. 7B, an electronic device 700' includes a processed metal case 704 instead of the metal case 701, compared to the electronic device 700. The metal case 704 may include a processed area at a part (e.g., the area shown in a dotted line) of the metal case 704. The processed area may have various shapes for adjusting the area of the metal case 704 or a current flow or for coupling with a radiator arranged in a side area (e.g., a nonmetal area). The processed area may be formed by cutting a part of the metal case (without splitting the metal case into two or more pieces). In various embodiments of the present disclosure, the processed area may be filled with a nonmetal material having an appropriate dielectric constant. The processed area of the metal case 704 may serve as a design element of the electronic device.

In various embodiments of the present disclosure, an antenna may be designed as a switchable or tunable antenna to obtain optimal performance. For example, the antenna (or antenna radiator) may be configured together with a tuner or a switch. For example, the tuner may be implemented in the form of a tunable capacitor chip. In various embodiments of the present disclosure, the tuner may adjust an RF response so that the RF response corresponds to various receiving bands of an electronic device. In addition, the tuner may perform a tuning operation so that the antenna properly operates even when an environment is changed, for example, when a human body or a conductor contacts or approaches the antenna. A radiator (e.g., the radiator 731 or 732) may be designed to have a meandered structure or a curved structure. In various embodiments of the present disclosure, the radiator (e.g., the radiator 731 or 732) may have one or more branches to receive signals of two or more frequency bands (e.g., B1 for wideband code division multiple access (WCDMA), B8 for LTE, Wi-Fi, GPS, and the like). In various embodiments of the present disclosure, the antenna may be manufactured through a laser direct structuring (LDS) process, a double injection process, or a process for forming an FPCB structure, a steel use stainless (SUS) structure or a metal ink painting structure.

Figure 8:
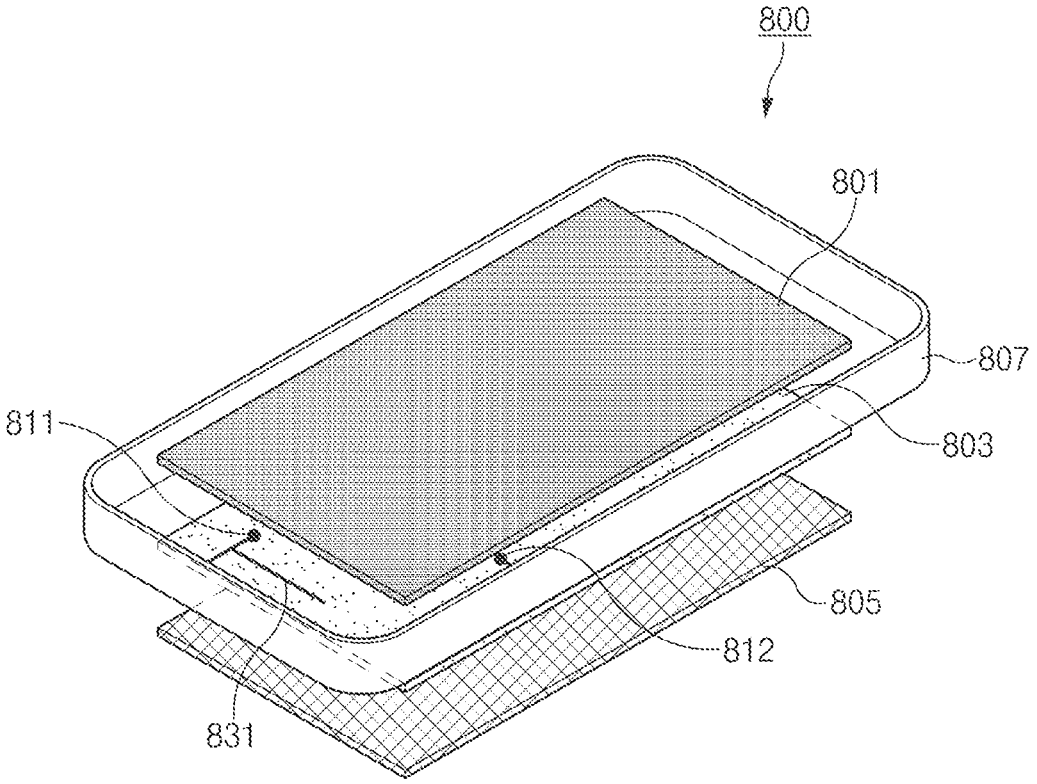
FIG. 8 is a diagram illustrating a method of using a metal case as an antenna radiator according to various embodiments of the present disclosure.

FIG. 8 is a diagram illustrating a method of using a metal case as an antenna radiator according to various embodiments of the present disclosure.

Referring to FIG. 8, an electronic device 800 may include a rear case 801, a substrate 803, a display panel 805, and a metal ring 807 that serves as a side case. In various embodiments of the present disclosure, the rear case 801 may be formed of a metal material (e.g., a metal battery case) or a nonmetal material (e.g., an injection-molded battery case).

In various embodiments of the present disclosure, a feeding line may be directly connected to the metal ring 807 at one point 811 of the substrate 803. When the metal ring 807 is fed by the feeding line, the metal ring 807 may operate as a part of an antenna. In various embodiments of the present disclosure, the feeding line may be connected from one or more points (e.g., points 811 and 812) of the substrate 803 to different points of the metal ring 807. In various embodiments of the present disclosure, an additional radiator pattern 831 may be provided to the feeding line. By virtue of the additional radiator pattern 831, a plurality of service bands may be secured. In various embodiments of the present disclosure, one or more metal structures (e.g., the metal ring 807 and the rear case 801) may be connected to each other, or any one of the metal structures may not be connected to any other metal structure, or at least one of the metal structures may be connected to another metal structure.

Figure 9:
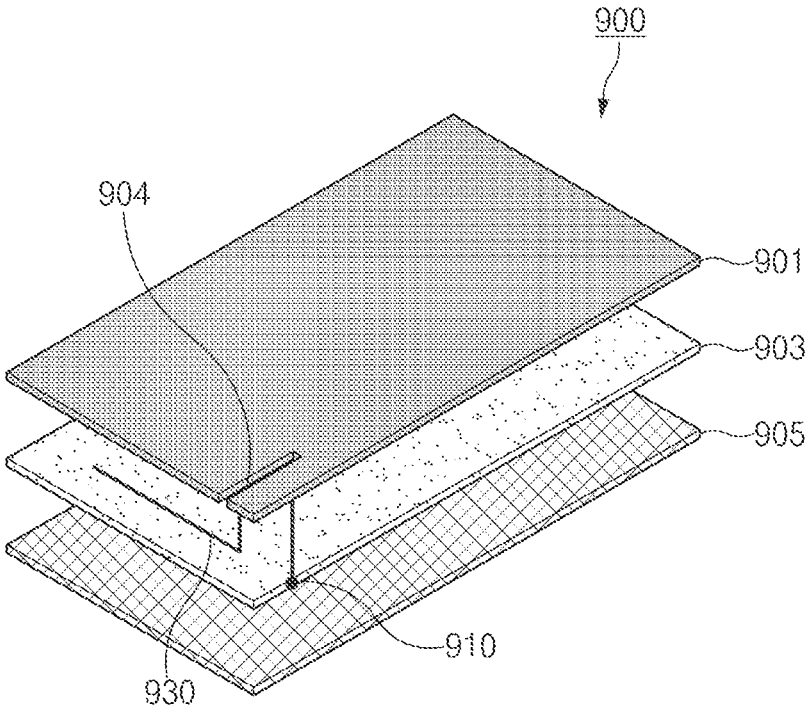
FIG. 9 is a diagram illustrating a processed metal case provided with an additional radiator according to various embodiments of the present disclosure.

FIG. 9 is a diagram illustrating a processed metal case provided with an additional radiator according to various embodiments of the present disclosure.

Referring to FIG. 9, an electronic device 900 may include a metal case 901, a substrate 903, and a display panel 905. In various embodiments of the present disclosure, the metal case 901 may have a slit structure, such as a slit 904. A plurality of slits may be provided, wherein the lengths, directions, shapes and positions of and distances between the slits may be determined so as to obtain optimal performance of an antenna or adjust a bandwidth.

In various embodiments of the present disclosure, a feeding line may be directly connected to the metal case 901 at one point (e.g., a point 910) of the substrate 903. In this case, the metal case 901 may operate as an antenna radiator. Furthermore, an additional radiator 930 may be extended from one point of the metal case 901. The additional radiator 930 may be arranged in a nonmetal area. The additional radiator 930 may be connected to the metal case 901 physically or electrically, and may have a coupling structure to improve the performance of the antenna.

Figure 10:
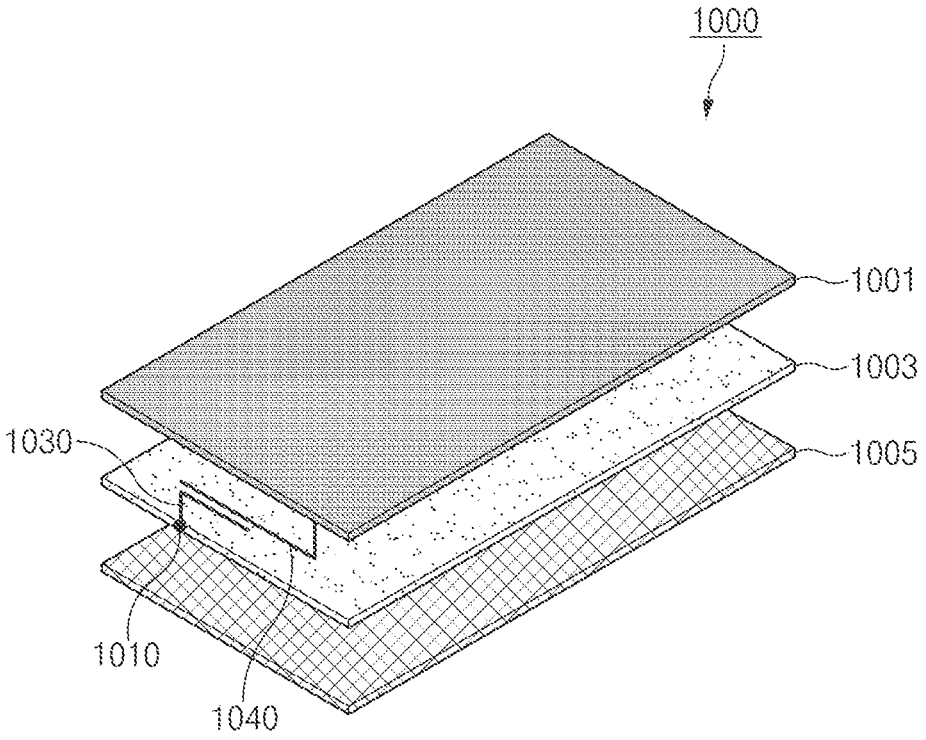
FIG. 10 is a diagram illustrating an antenna having a coupling structure according to various embodiments of the present disclosure.

FIG. 10 is a diagram illustrating an antenna having a coupling structure according to various embodiments of the present disclosure.

Referring to FIG. 10, an electronic device 1000 may include a metal case 1001, a substrate 1003, and a display panel 1005. In various embodiments of the present disclosure, the electronic device 1000 may include an antenna radiator 1030 fed by a feeding unit 1010 of the substrate 1003. Furthermore, the electronic device 1000 may include an additional radiator 1040 extended from the metal case 1001. In various embodiments of the present disclosure, the radiator 1030 may be coupled with the radiator 1040. Furthermore, the radiator 1030 may be coupled through an additional branch extended from a metal structure, such as the metal 1001, a metal ring (not illustrated) or the display panel 1005.

Figure 11:
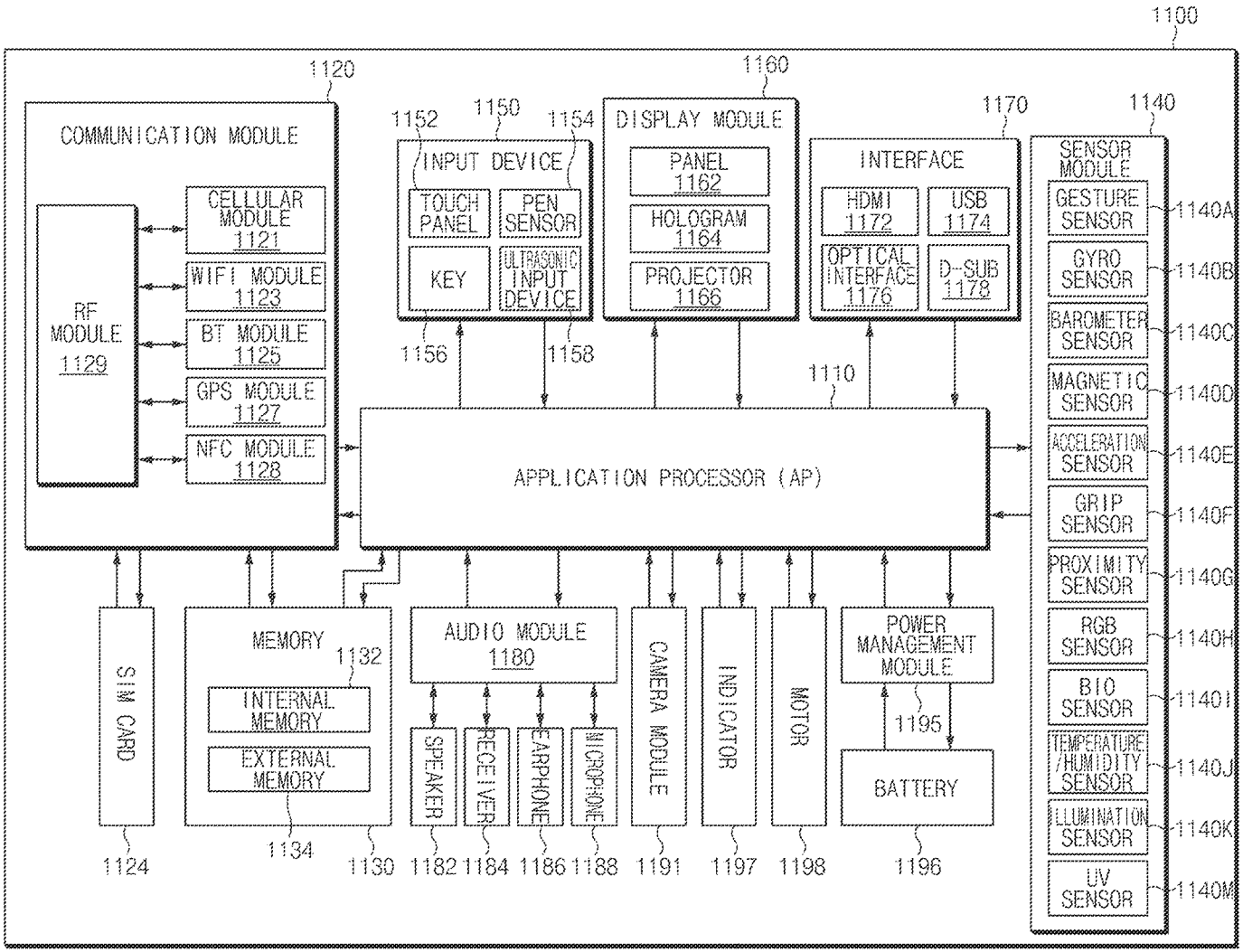
FIG. 11 is a block diagram illustrating a hardware structure of an electronic device according to various embodiments of the present disclosure.

FIG. 11 is a block diagram illustrating a hardware structure of an electronic device according to various embodiments of the present disclosure.

Referring to FIG. 11, an electronic device 1100 may include at least one application processor (AP) 1110, a communication module 1120, a subscriber identification module (SIM) card 1124, a memory 1130, a sensor module 1140, an input device 1150, a display 1160, an interface 1170, an audio module 1180, a camera module 1191, a power management module 1195, a battery 1196, an indicator 1197 or a motor 1198.

The AP 1110 may run an operating system or an application program so as to control a plurality of hardware or software components connected to the AP 1110, and may process various data including multimedia data and may perform an operation. The AP 1110 may be implemented with, for example, a system on chip (SoC). According to an embodiment of the present disclosure, the AP 1110 may further include a graphic processing unit (GPU, not illustrated).

The communication module 1120 may perform data transmission/reception for communication between the electronic device 1100 and other electronic devices connected thereto through a network. According to an embodiment of the present disclosure, the communication module 1120 may include a cellular module 1121, a Wi-Fi module 1123, a BT module 1125, a GPS module 1127, an NFC module 1128, and an RF module 1129.

The cellular module 1121 may provide a voice call service, a video call service, a text message service, or an Internet service through a telecommunications network (e.g., LTE, LTE-advanced (LTE-A), CDMA, WCDMA, universal mobile telecommunications service (UMTS), wireless broadband (WiBro) or global system for mobile communications (GSM) network). Furthermore, the cellular module 1121 may identify and authenticate electronic devices in the telecommunications network using, for example, a SIM (e.g., the SIM card 1124). According to an embodiment of the present disclosure, the cellular module 1121 may perform at least a part of functions provided by the AP 1110. For example, the cellular module 1121 may perform at least a part of a multimedia control function.

According to an embodiment of the present disclosure, the cellular module 1121 may include a communication processor (CP). The cellular module 1121 may be implemented with, for example, an SoC. Although FIG. 11 illustrates that the cellular module 1121 (e.g., a CP), the memory 1130 and the power management module 1195 are separated from the AP 1110, the AP 1110 may include at least a part of the foregoing elements (e.g., the cellular module 1121), according to an embodiment of the present disclosure.

According to an embodiment of the present disclosure, the AP 1110 or the cellular module 1121 (e.g., a CP) may load, on a volatile memory, a command or data received from at least one of a nonvolatile memory and another element connected to the AP 1110 or the cellular module 1121, so as to process the command or data. Furthermore, the AP 1110 or the cellular module 1121 may store, in the nonvolatile memory, data received from or generated by at least one of the other elements.

Each of the Wi-Fi module 1123, the BT module 1125, the GPS module 1127 and the NFC module 1128 may include, for example, a processor for processing data transmitted/received through the modules. FIG. 11 illustrates the cellular module 1121, the Wi-Fi module 1123, the BT module 1125, the GPS module 1127 and the NFC module 1128 as if the modules are separate blocks. However, according to an embodiment of the present disclosure, at least a part (e.g., two or more) of the cellular module 1121, the Wi-Fi module 1123, the BT module 1125, the GPS module 1127 and the NFC module 1128 may be included in a single integrated chip (IC) or IC package. For example, at least a part (e.g., a communication processor corresponding to the cellular module 1121 and a Wi-Fi processor corresponding to the Wi-Fi module 1123) of the cellular module 1121, the Wi-Fi module 1123, the BT module 1125, the GPS module 1127 and the NFC module 1128 may be implemented with a single SoC.

The RF module 1129 may transmit/receive data, for example, may transmit/receive an RF signal. Although not illustrated, for example, a transceiver, a power amp module (PAM), a frequency filter or a low noise amplifier (LNA) may be included in the RF module 1129. Furthermore, the RF module 1129 may further include a component, such as a conductor or a wire for transmitting/receiving free-space electromagnetic waves in a wireless communication system.

FIG. 11 illustrates the cellular module 1121, the Wi-Fi module 1123, the BT module 1125, the GPS module 1127 and the NFC module 1128 as if the modules share the single RF module 1129. However, according to an embodiment of the present disclosure, at least one of the cellular module 1121, the Wi-Fi module 1123, the BT module 1125, the GPS module 1127 and the NFC module 1128 may transmit/receive RF signals through an additional RF module.

The SIM card 1124 may include a SIM, and may be inserted into a slot formed at a specific location of the electronic device. The SIM card 1124 may include unique identification information (e.g., an integrated circuit card identifier (ICCID)) or subscriber information (e.g., international mobile subscriber identity (IMSI)).

The memory 1130 may include an internal memory 1132 or an external memory 1134. The internal memory 1132 may include at least one of a volatile memory (e.g., a dynamic random access memory (DRAM), a static RAM (SRAM) or a synchronous DRAM (SDRAM)) and a nonvolatile memory (e.g., a one-time programmable read only memory (OTPROM), a PROM, an erasable and programmable ROM (EPROM), an electrically erasable and programmable ROM (EEPROM), a mask ROM, a flash ROM, a NAND flash memory, or a NOR flash memory).

According to an embodiment of the present disclosure, the internal memory 1132 may be a solid state drive (SSD). The external memory 1134 may include a flash drive, for example, compact flash (CF), secure digital (SD), micro-SD, mini-SD, extreme digital (xD) or a memory stick. The external memory 1134 may be functionally connected to the electronic device 1100 through various interfaces. According to an embodiment of the present disclosure, the electronic device 1100 may further include a storage device (or a storage medium), such as a hard drive.

The sensor module 1140 may measure physical quantity or detect an operation state of the electronic device 1100 so as to convert measured or detected information into an electrical signal. The sensor module 1140 may include, for example, at least one of a gesture sensor 1140A, a gyro sensor 1140B, an atmospheric pressure sensor 1140C, a magnetic sensor 1140D, an acceleration sensor 1140E, a grip sensor 1140F, a proximity sensor 1140G, a color sensor 1140H (e.g., red, green, blue (RGB) sensor), a biometric sensor 1140I, a temperature/humidity sensor 1140J, an illuminance sensor 1140K, and an ultraviolet (UV) sensor 1140M. Although not illustrated, additionally or alternatively, the sensor module 1140 may include, for example, an olfactory sensor (E-nose sensor), an electromyography (EMG) sensor, an electroencephalogram (EEG) sensor, an electrocardiogram (ECG) sensor, a photoplethysmography (PPG) sensor, an infrared (IR) sensor, an iris recognition sensor, a fingerprint sensor, and the like. The sensor module 1140 may further include a control circuit for controlling at least one sensor included therein.

The input device 1150 may include a touch panel 1152, a (digital) pen sensor 1154, a key 1156, or an ultrasonic input device 1158. The touch panel 1152 may recognize a touch input using at least one of capacitive, resistive, infrared and ultraviolet detecting methods. The touch panel 1152 may further include a control circuit. In the case of using the capacitive detecting method, a physical contact recognition or proximity recognition is allowed. The touch panel 1152 may further include a tactile layer. In this case, the touch panel 1152 may provide tactile reaction to a user.

The (digital) pen sensor 1154 may be implemented in a similar or same manner as the method of receiving a touch input of a user or may be implemented using an additional sheet for recognition. The key 1156 may include, for example, a physical button, an optical button, a keypad, and the like. The ultrasonic input device 1158, which is an input device for generating an ultrasonic signal, may enable the electronic device 1100 to detect a sound wave through a microphone (e.g., a microphone 1188) so as to identify data, wherein the ultrasonic input device 1158 is capable of wireless recognition. According to an embodiment of the present disclosure, the electronic device 1100 may use the communication module 1120 so as to receive a user input from an external device (e.g., a computer or server) connected to the communication module 1120.

The display 1160 may include a panel 1162, a hologram device 1164, or a projector 1166. The panel 1162 may be, for example, a liquid crystal display (LCD) or an active-matrix organic light-emitting diode (AM-OLED). The panel 1162 may be, for example, flexible, transparent or wearable. The panel 1162 and the touch panel 1152 may be integrated into a single module. The hologram device 1164 may display a stereoscopic image in a space using a light interference phenomenon. The projector 1166 may project light onto a screen so as to display an image. The screen may be arranged in the inside or the outside of the electronic device 1100. According to an embodiment of the present disclosure, the display 1160 may further include a control circuit for controlling the panel 1162, the hologram device 1164, or the projector 1166.

The interface 1170 may include, for example, a high definition multimedia interface (HDMI) 1172, a USB 1174, an optical interface 1176, or a D-subminiature 1178. Additionally or alternatively, the interface 1170 may include, for example, a mobile high-definition link (MHL) interface, an SD card/multi-media card (MMC) interface, an IrDA interface, and the like.

The audio module 1180 may convert a sound into an electrical signal or vice versa. The audio module 1180 may process sound information input or output through a speaker 1182, a receiver 1184, an earphone 1186, or the microphone 1188.

According to an embodiment of the present disclosure, the camera module 1191 for shooting a still image or a video may include at least one image sensor (e.g., a front sensor or a rear sensor), a lens (not illustrated), an image signal processor (ISP, not illustrated), or a flash (e.g., an LED or a xenon lamp, not illustrated).

The power management module 1195 may manage power of the electronic device 1100. Although not illustrated, a power management integrated circuit (PMIC), a charger IC, or a battery or fuel gauge may be included in the power management module 1195.

The PMIC may be mounted on an integrated circuit or an SoC semiconductor. A charging method may be classified into a wired charging method and a wireless charging method. The charger IC may charge a battery, and may prevent an overvoltage or an overcurrent from being introduced from a charger. According to an embodiment of the present disclosure, the charger IC may include a charger IC for at least one of the wired charging method and the wireless charging method. The wireless charging method may include, for example, a magnetic resonance method, a magnetic induction method or an electromagnetic method, and may include an additional circuit, for example, a coil loop, a resonant circuit, a rectifier, and the like.

The battery gauge may measure, for example, a remaining capacity of the battery 1196 and a voltage, current or temperature thereof while the battery is charged. The battery 1196 may store or generate electricity, and may supply power to the electronic device 1100 using the stored or generated electricity. The battery 1196 may include, for example, a rechargeable battery or a solar battery.

The indicator 1197 may display a specific state of the electronic device 1100 or a part thereof (e.g., the AP 1110), such as a booting state, a message state, a charging state, and the like. The motor 1198 may convert an electrical signal into a mechanical vibration. Although not illustrated, a processing device (e.g., a GPU) for supporting a mobile TV may be included in the electronic device 1100. The processing device for supporting a mobile TV may process media data according to the standards of DMB, digital video broadcasting (DVB) or media flow.

Each of the above-mentioned elements of the electronic device according to various embodiments of the present disclosure may be configured with one or more components, and the names of the elements may be changed according to the type of the electronic device. The electronic device according to various embodiments of the present disclosure may include at least one of the above-mentioned elements, and some elements may be omitted or other additional elements may be added. Furthermore, some of the elements of the electronic device according to various embodiments of the present disclosure may be combined with each other so as to form one entity, so that the functions of the elements may be performed in the same manner as before the combination.

The term "module" used herein may represent, for example, a unit including one or more combinations of hardware, software and firmware. The term "module" may be interchangeably used with the terms "unit", "logic", "logical block", "component" and "circuit". The "module" may be a minimum unit of an integrated component or may be a part thereof. The "module" may be a minimum unit for performing one or more functions or a part thereof. The "module" may be implemented mechanically or electronically. For example, the "module" according to various embodiments of the present disclosure may include at least one of an application-specific IC (ASIC) chip, a field-programmable gate array (FPGA), and a programmable-logic device for performing some operations, which are known or will be developed.

An electronic device provided with an antenna according to various embodiments of the present disclosure may include a substrate including a grounding area, a non-grounding area and at least one feeding unit for feeding an antenna radiator, and a non-segmented metal case that forms an outer frame of the electronic device and serves as a part of the antenna. In this case, a nonmetal area may be arranged between the metal case and the substrate.

In various embodiments of the present disclosure, the electronic device may further include a display panel connected to the grounding area, wherein the display panel may provide an additional grounding area for the grounding area.

In various embodiments of the present disclosure, the radiator may be arranged in the nonmetal area, the non-segmented metal case may be connected to the grounding area at one or more points, and the non-segmented metal case may operate as an impedance matching element of the antenna. This connection may be established using at least one of a c-clip, a pogo pin, and a conductive tape.

In various embodiments of the present disclosure, the at least one feeding unit may directly feed the non-segmented metal case, and the fed non-segmented metal case may operate as a part of the antenna radiator. Furthermore, the electronic device may further include an additional radiator extended from the non-segmented metal case. Furthermore, the non-segmented metal case may include a slit structure.

In various embodiments of the present disclosure, the non-segmented metal case may be a rear battery case of the electronic device. In this case, a side case of the electronic device may be formed of a nonmetal material.

In various embodiments of the present disclosure, the non-segmented metal case may correspond to a side case of the electronic device. In this case, the side case may have the form of a metal ring.

In various embodiments of the present disclosure, the non-segmented metal case may be provided with an additional radiator extending toward the nonmetal area, wherein the additional radiator may be coupled with the antenna radiator.

In various embodiments of the present disclosure, at least a part of the antenna radiator may be patterned on the substrate, and the other part of the antenna radiator may be formed in the nonmetal area.

In various embodiments of the present disclosure, the antenna radiator may include at least one branch structure for transmitting/receiving a signal of a certain frequency band.

In various embodiments of the present disclosure, the nonmetal area may be formed of a material having a dielectric constant for tuning the antenna.

In various embodiments of the present disclosure, the non-segmented metal case may be connected to the grounding area so as to provide an additional grounding area.

In various embodiments of the present disclosure, the antenna radiator may include a structure provided with a tunable element or a switching element.

Figure 12:
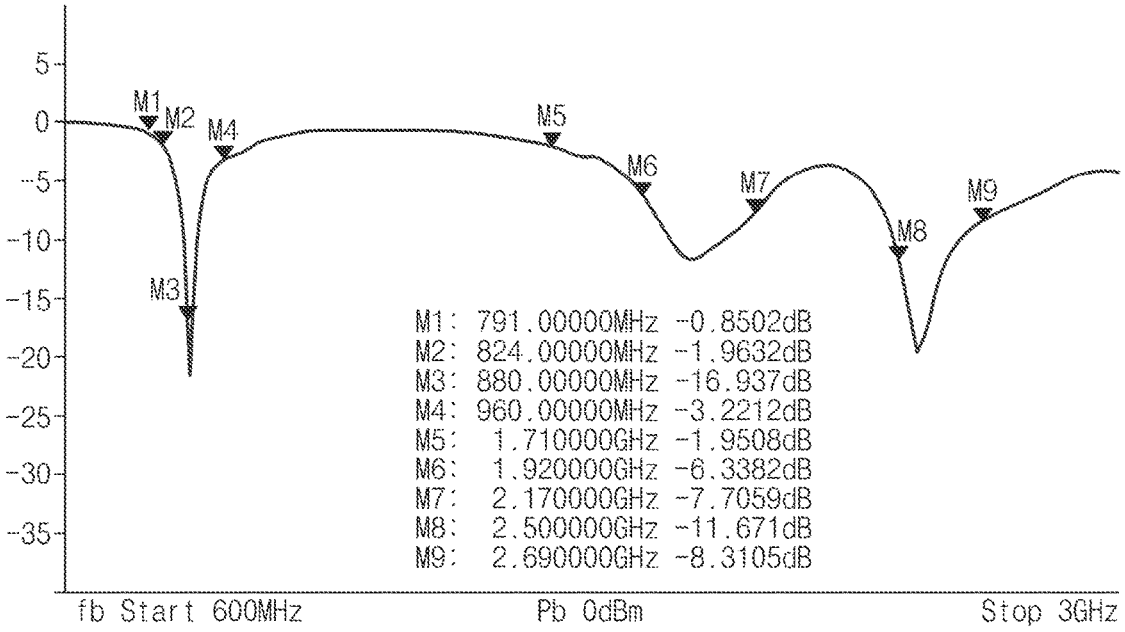
FIG. 12 is a graph illustrating a reflection coefficient of an antenna device according to various embodiments of the present disclosure.

FIG. 12 is a graph illustrating a reflection coefficient of an antenna device according to various embodiments of the present disclosure.

Figure 7:
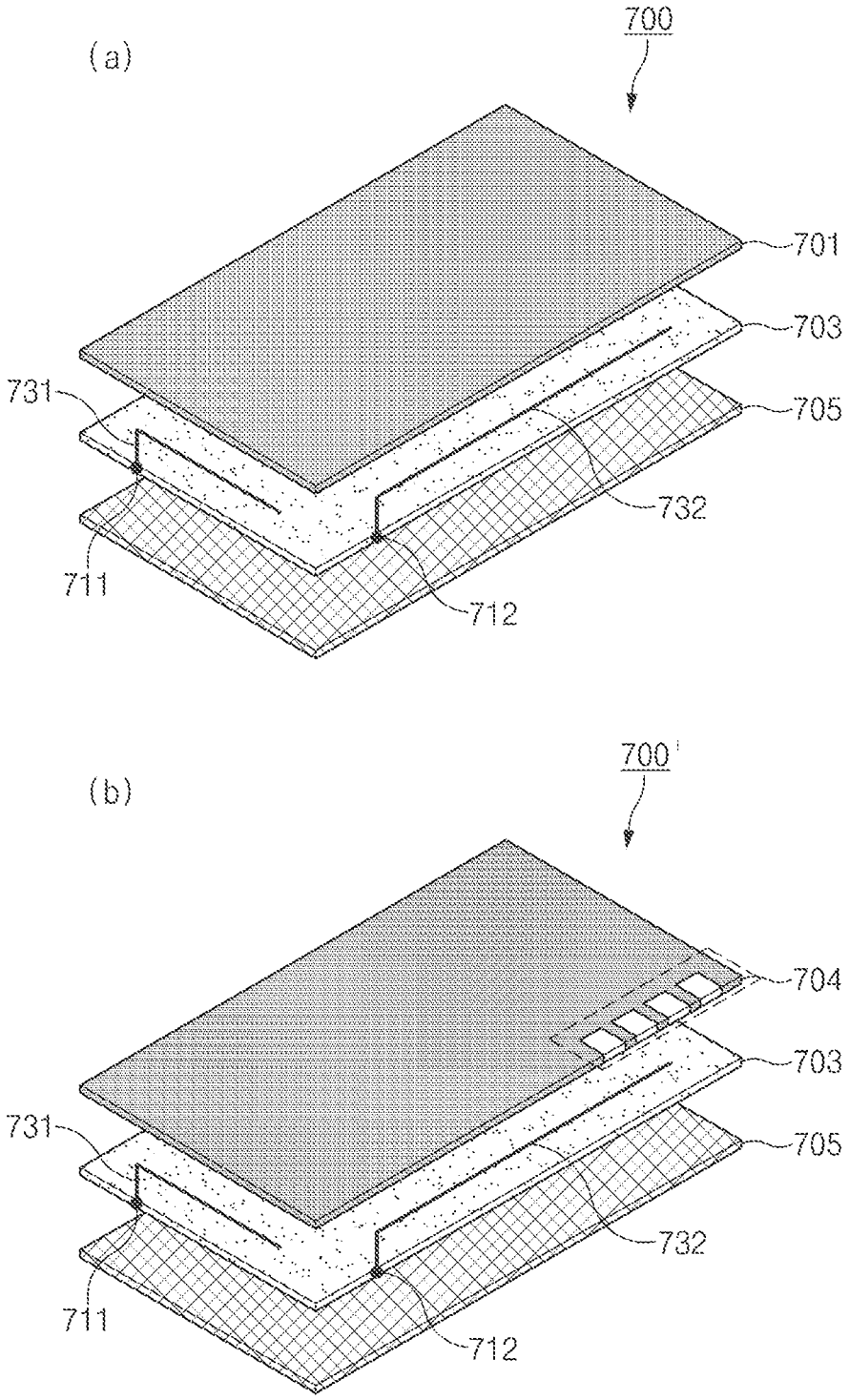
FIGS. 7A and 7B illustrate a method of arranging an antenna radiator in a nonmetal area between a metal case and a substrate according to various embodiments of the present disclosure.

The radiation performance illustrated in FIG. 12 may be a result of implementation of the structure of FIG. 7.

Referring to FIG. 12, resonance of a low band (M3, 880 MHz band) may be secured by an electrical length of an antenna radiator (e.g., the radiator 731). Resonance of middle bands (M5-M7, 1710-2170 MHz) may be implemented by virtue of a pattern forming feature of the antenna radiator (e.g., the radiator 731) and a harmonic component (e.g., 880 (M3)×2=1760 MHz, a harmonic resonant component of an antenna may be formed at a band of about two times a frequency in a ground having a limited area). Resonance of a high band (M8-M9, 2500-2690 MHz) may be implemented by a branch structure (not illustrated in FIG. 7) extended from one point of the antenna radiator. The radiation performance illustrated in FIG. 12 may be achieved by virtue of an extending radiator structure implemented at a single port (e.g., the feeding unit 711). However, in various embodiments of the present disclosure, the radiation performance may also be achieved by virtue of a radiator structure extending from two or more ports (e.g., the feeding units 711 and 712).

According to various embodiments of the present disclosure, the robustness of an electronic device may be secured using a metal case, while achieving a desired radiation performance of an antenna.

Furthermore, according to various embodiments of the present disclosure, a metal case may be used as an antenna radiator, a grounding area of an antenna, or a matching unit.

Certain aspects of the present disclosure can also be embodied as computer readable code on a non-transitory computer readable recording medium. A non-transitory computer readable recording medium is any data storage device that can store data which can be thereafter read by a computer system. Examples of the non-transitory computer readable recording medium include a Read-Only Memory (ROM), a Random-Access Memory (RAM), Compact Disc-ROMs (CD-ROMs), magnetic tapes, floppy disks, and optical data storage devices. The non-transitory computer readable recording medium can also be distributed over network coupled computer systems so that the computer readable code is stored and executed in a distributed fashion. In addition, functional programs, code, and code segments for accomplishing the present disclosure can be easily construed by programmers skilled in the art to which the present disclosure pertains.

At this point it should be noted that the various embodiments of the present disclosure as described above typically involve the processing of input data and the generation of output data to some extent. This input data processing and output data generation may be implemented in hardware or software in combination with hardware. For example, specific electronic components may be employed in a mobile device or similar or related circuitry for implementing the functions associated with the various embodiments of the present disclosure as described above. Alternatively, one or more processors operating in accordance with stored instructions may implement the functions associated with the various embodiments of the present disclosure as described above. If such is the case, it is within the scope of the present disclosure that such instructions may be stored on one or more non-transitory processor readable mediums. Examples of the processor readable mediums include a ROM, a RAM, CD-ROMs, magnetic tapes, floppy disks, and optical data storage devices. The processor readable mediums can also be distributed over network coupled computer systems so that the instructions are stored and executed in a distributed fashion. In addition, functional computer programs, instructions, and instruction segments for accomplishing the present disclosure can be easily construed by programmers skilled in the art to which the present disclosure pertains.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. An electronic device comprising:
a first antenna radiator;
a substrate comprising:
a first grounding area for the first antenna radiator,
a non-grounding area, and
at least one feeding unit;
a non-segmented metal case comprising a rear case of the electronic device; and
a nonmetal area arranged between the non-segmented metal case and the substrate,
wherein the at least one feeding unit feeds the first antenna radiator,
wherein the rear case is directly connected to the first grounding area of the substrate,
wherein the rear case includes a second grounding area for the first antenna radiator, and
wherein at least a part of the first antenna radiator is patterned on the substrate, and the other part of the first antenna radiator is arranged in the nonmetal area.

2. The electronic device of claim 1, further comprising:
a display panel connected to the first grounding area,
wherein the display panel provides a third grounding area for the first antenna radiator.

3. The electronic device of claim 1, further comprising:
a side case formed of a nonmetal material.

4. The electronic device of claim 1, further comprising:
a second antenna radiator arranged in the nonmetal area,
wherein the second antenna radiator is coupled with the first antenna radiator.

5. The electronic device of claim 1, wherein the first antenna radiator includes a branch structure for transmitting/receiving a signal of a certain frequency band.

6. The electronic device of claim 1, wherein the nonmetal area includes a dielectric constant for tuning the antenna.

7. The electronic device of claim 1, wherein the first antenna radiator is integrated with a tuner or a switch.

8. The electronic device of claim 1, further comprising:
a side case formed of a non-segmented metal material.

* * * * *